United States Patent [19]

Massey

[11] 4,264,276

[45] Apr. 28, 1981

[54] WATER WHEEL FOR EXERTING FLOTATION AND PROPELLING FORCES

[76] Inventor: Jerald L. Massey, 2671 St. Clara Dr., Macon, Ga. 31206

[21] Appl. No.: 30,552

[22] Filed: Apr. 16, 1979

Related U.S. Application Data

[63] Continuation-in-part of Ser. No. 804,702, Jun. 8, 1977, abandoned.

[51] Int. Cl.[3] ..... B63H 5/02

[52] U.S. Cl. ..... 416/86; 416/184; 416/197 R

[58] Field of Search ..... 416/84–86, 416/184, 199, 197 R; 415/87

[56] References Cited

U.S. PATENT DOCUMENTS

| | | | |
|---|---|---|---|
| 1,893 | 12/1840 | Burnham | 416/84 |
| 10,235 | 11/1853 | Muntz | 416/199 |
| 461,669 | 10/1891 | Dunlap | 416/84 |
| 1,367,532 | 2/1921 | Branan | 416/184 |
| 1,985,705 | 12/1934 | Whiton | 416/184 |
| 2,165,808 | 7/1939 | Murphy | 416/185 |
| 2,358,937 | 9/1944 | Melton | 416/86 |
| 2,404,044 | 7/1946 | Falk | 416/197 |
| 2,730,631 | 1/1956 | Dandini | 416/86 X |
| 3,149,823 | 9/1964 | Entrikin | 416/184 X |
| 3,594,096 | 7/1971 | Kahike | 416/84 |

*Primary Examiner*—Everette A. Powell, Jr.
*Attorney, Agent, or Firm*—James B. Middleton

[57] ABSTRACT

A water wheel for providing both flotation and propelling forces. The water wheel includes a disc made up of a pair of side walls spaced apart in their center area and joined at their peripheries to define a cavity. Paddle members are fixed to the outside of the disc, and have a curved working surface for acting against water as the wheel rotates. The leading edge of the paddle members cuts into the water without creating turbulence, and water flow over the rest of the paddle member is smooth.

3 Claims, 6 Drawing Figures

WATER WHEEL FOR EXERTING FLOTATION AND PROPELLING FORCES

CROSS-REFERENCE TO RELATED APPLICATION

This application is a continuation-in-part of the copending application of Jerald L. Massey, entitled "Water Wheel for Exerting Flotation and Propelling Forces", filed June 8, 1977, under Ser. No. 804,702, now abandoned.

FIELD OF THE INVENTION

This invention relates generally to vehicle flotation and propelling means, and is more particularly concerned with an improved water wheel having curved paddle members for exerting both flotation and propelling forces.

BACKGROUND OF THE INVENTION

When a vehicle is to move across water, the most common technique is to provide a floatable vehicle, and to use some means for propelling the vehicle through the water. The difficulty with this arrangement is that the drag on the vehicle increases as the length of the water line increases, so very large motive forces are required to move a large vehicle at even slow speeds.

The most common effort to solve the problem of the slow speed of a water going vehicle, other than by simply increasing the available power, has been to provide a more effective propelling means so that various screw-type propellers, paddle wheels, and the like have been devised. While such improved propelling means may deliver more of the available power to the vehicle, the large amount of drag on the vehicle still prevents very great speeds for large vehicles and requires a lot of power. Another means for solving the problem of the slow speed of a water-going vehicle is to provide foils so the vehicle can ride on the water foils, thereby reducing the drag and allowing the vehicle to move at relatively high speeds. While the use of foils has indeed allowed vehicles to attain high speeds, it is difficult to provide the strength necessary to support foils on a large vessel because of the stresses involved. In addition, an extremely large motive force is required to propel the vehicle fast enough for the vehicle to rise from the water to be supported solely by the foils.

Another attempt at solving the problem of moving a vehicle through water has been the use of a wheel-type propelling means wherein rapidly rotating paddle members exert flotation forces to cause the vehicle to rise in the water, and exert propelling forces to urge the vehicle along in the water. While several such devices have been provided in the past, none has achieved any noticeable commercial success. Such prior art water wheels have utilized, variously, hollow drums to assist in flotation, moveable paddles to assist in providing propelling forces, and other such apparatus. One of the primary problems with water wheels of this general variety is that the water wheel is not effective except at relatively high speeds, and most of the prior art water wheels would come apart at the required high rotational speeds. Also, such a water wheel must act against the water; therefore, if the paddle members of the water wheel agitate the water to the point that the water wheel is immersed in a froth, the water wheel loses its effectiveness. Another common problem with such water wheels is the lack of lateral stability. Side plates have been used on some water wheels, but such plates would allow air pockets between the paddle members and otherwise restrict water flow which severely diminishes the effectiveness of the water wheel.

SUMMARY OF THE INVENTION

The present invention overcomes the abovementioned and other difficulties with the prior art water wheels by providing a water wheel having a plurality of outwardly curved paddle members rotatable about an axis. A disc is fixed generally along the centerline of the paddle members perpendicularly to the axis, the disc providing lateral stability for the water wheel without restricting water flow over the paddle members, and acting as a strengthening means to support the paddle members. In the preferred embodiment of the invention, the disc is hollow to provide some buoyant forces.

BRIEF DESCRIPTION OF THE DRAWINGS

These and other features and advantages of the present invention will become apparent from consideration of the following specification when taken in conjunction with the accompanying drawings in which.

DESCRIPTION OF AN EMBODIMENT OF THE INVENTION

Figure 3:
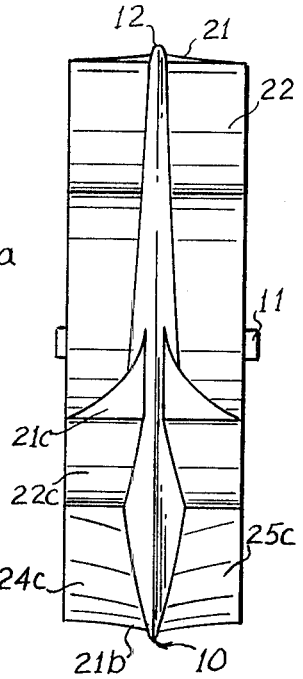
FIG. 3 is a front elevational view of the device shown in FIG. 1.
Figure 2:
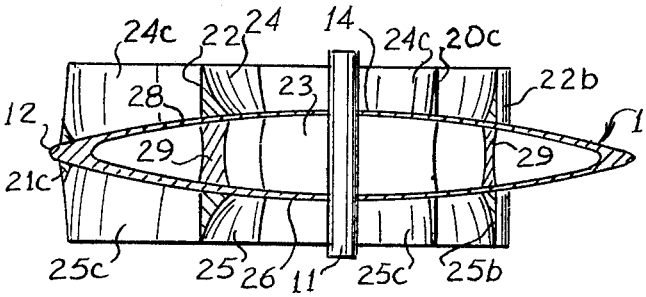
FIG. 2 is a cross-sectional view taken substantially along the line 2—2 in FIG. 1.

Referring now more particularly to the drawings, and to that embodiment of the invention here chosen by way of illustration, it will be seen that the water wheel of the present invention includes a central disc 10 having a shaft 11 at its axis. As best seen in FIGS. 2 and 3 of the drawings, the disc 10 has a small radius at its outermost edge, or circumference 12, and is much wider at its center portion 14.

Figure 1:
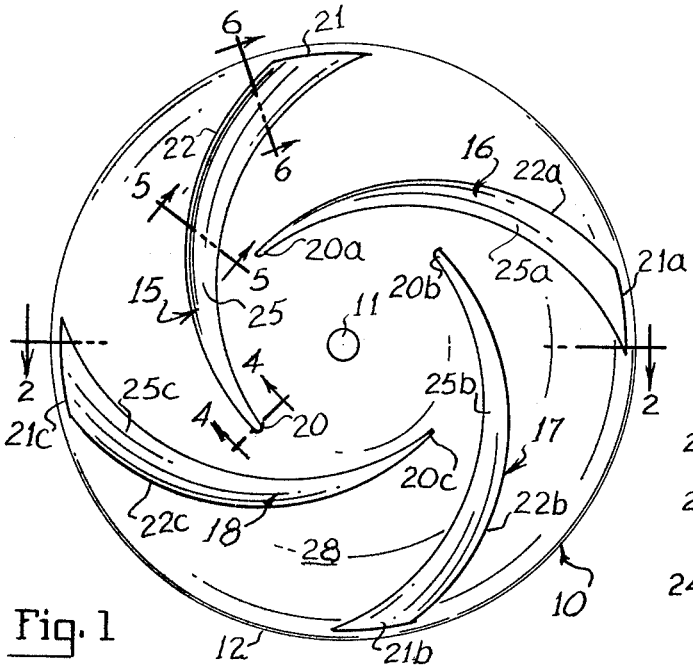
FIG. 1 is a side elevational view of one form of water wheel made in accordance with the present invention.

The disc 10 has a plurality of paddle members designated at 15, 16, 17 and 18 fixed thereto. In FIG. 1 it will be seen that each of the paddle members is identical to the others, so only the paddle member 15 will be described in detail, and the same reference numerals with a letter suffix will be applied to the same parts of other paddle members. The suffix a will designate parts of paddle member 16, b will designate parts of paddle member 17, and c will designate parts of paddle member 18.

Returning now to FIG. 1 of the drawing, the paddle member 15 includes a leading edge 20 that is located inwardly of the circumference 12, and the paddle member 15 curves outwardly towards the circumference 12 so that its outermost end 21 is closely adjacent to the circumference 12. The configuration of the paddle member 15 is arcuate with the working surface 22 constantly approaching the circumference 12 from the leading edge 20. The reason for this construction will be discussed in more detail hereinafter.

The working surface 22 of the paddle member 15 is a generally flat surface parallel to the axis of the disc 10. To create this working surface 22 and to fix the member to the disc 10, the paddle member 15 is provided with fillets 24 and 25 on the inner side of the member 15.

Figure 4:
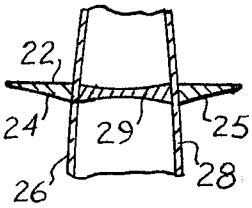
FIGS. 4, 5, and 6 are cross-sectional views taken respectively along the lines 4—4, 5—5 and 6—6 in FIG. 1.
Figure 5:
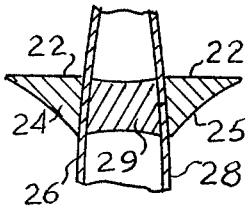
Figure 6:
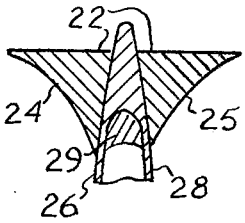

As is more clearly shown in FIGS. 4, 5 and 6, the fillets 24 and 25 vary in cross-section from the leading edge 20 to the outermost end 21. At the leading edge 20, the fillets 24 and 25 are quite small so that the paddle member appears truly as paddles extending from the disc 10. However, the fillets 24 and 25 change in cross-sectional size and shape to provide an increasingly large and effective buttress for the working surface 22 of the paddle member 15.

At the outermost end 21 of the paddle member 15, it will be seen that the fillets 24 and 25 extend generally parallel to the circumference 12 after the working surface 22 has terminated.

At this point it should be realized that the paddle members 15, 16, 17 and 18 extend to both sides of the disc 10 so that the disc 10 is effectively placed along the center of the paddle members. This overall arrangement is highly desirable in that the disc 10 provides a rudder-like action in water so that the water wheel of the present invention provides lateral stability in water. With the disc 10 centrally of the paddles, there is no possibility of air pockets or the like so that the paddle members retain their maximum efficiency.

As here illustrated the disc 10 is hollow in the middle. The cavity 23 within the disc 10 provides some buoyancy, though it is not anticipated that the water wheels of the present invention will provide enough buoyant forces to float a large vessel statically. If desired, of course, a solid disk may be used so that the water wheel would rely solely on the buoyant forces generated by action of the paddle members 15, 16, 17 and 18.

Since one of the problems with prior art water wheels has been the strength to withstand high speed rotation, it will be understood that a completely hollow disc 10 may not allow sufficient strength for some uses of the wheel of the present invention. To obtain greater strength when needed, a bridge may be used, extending across the cavity 23 of the disc 10 between sides of the paddle members. This structure is best shown in FIGS. 4–6 where it will be seen that a bridge 29 extends between the walls 26 and 28 of the disc 10; furthermore, the bridge 29 increases in size as the fillets 24 and 25 increase in size.

It should now be understood that the paddle member 15 has its leading end 20 inward of the circumference 12, and the end portion of the working surface 22 rather nearly parallel to the direction of motion. As a result, as the disc 10 rotates, the end 20 will enter the water very smoothly, causing very little turbulence of the water. The working surface 22 will not cause appreciable turbulence because the slope with respect to the direction of travel is slight. Thus, very little stress will be exerted on the end 20, and the fillets 24 and 25 can be rather minimal, as shown.

It is important to note with respect to the leading edge 20 that the edge 20 is unobstructed so water can flow over the edge 20 and onto the working surface 22. Further, both sides of the paddle member 15 are free so that the water can flow smoothly over both sides with no air pockets and no appreciable turbulence.

Moving from the end 20 along the paddle member 15, the working surface 22 curves towards the axle 11 as it approaches the circumference 12. The result is that the working surface 22 is at all points angularly disposed to the circumference 12. It should also be noted that the fillets 24 and 25 increase to provide the needed strength.

Looking now primarily at FIG. 1 of the drawing, it will be seen that the plurality of paddle members 15, 16, 17 and 18 are arranged so that, generally, two of the paddle members will be working at any given time. The leading end 20 of the paddle member 15 is on the same radius of the disc 10 as approximately the middle section of the paddle member 18, and so on around the circle.

With the foregoing in mind, the operation of the device should be understood. One would mount one or more of the water wheels on a vehicle as desired. On a conventional boat or the like, three or four of the water wheels could be used so the entire boat would be supported by the water wheels, and conventional means could be used to drive the wheels by rotating the axles 11.

When the water wheels of the present invention are stationary, the buoyancy would be so slight that some other static flotation means may be necessary. However, when the axle 11 is rotated to cause the disc 10 to rotate, the leading edge 20 of the paddle member 15 would be immersed in the water. The entry into the water would be smooth with little or no turbulence; and, as the disc 10 continues to rotate, the working surface 22 will tend to push against the water. At the outermost end 21 of the paddle member 15, the working surface 22 stops, but the fillets 24 and 25 continue as best shown in FIG. 3 so, again, turbulence is kept to a minimum. Also, of course, the extending fillets provide great strength at the end of the paddle members.

With the disc 10 made hollow as shown, and the fillets 24 and 25 rather small inwardly of the disc 10, the greater part of the weight of the water wheel is outwardly of the disc 10, towards the circumference 12. This fact increases the moment of inertia, as will be understood by those skilled in the art, and makes the wheel into a very good flywheel. Thus, as the water wheel is rotated by an appropriate motive force, the moment of inertia will stabilize the speed.

When the disc 10 is rotating at high speed, one paddle member will be acting against the water to provide flotation force; and, when that first paddle member is working at about its mid-section, the next paddle member will begin to work against the water. Thus, the leading end 20 of the paddle member, which does very little work, enters the water while the preceding paddle member is exerting a large force.

It will also be realized that, when the disc 10 is rotating at high speed, the outer end of the paddle member will be moved through the water so fast that a void will tend to form on the fillet side of the paddle member. This void, or partial vacuum, will cause the paddle member to move into that area of low pressure, and will therefore assist in flotation of the device.

From an inspection of the working surfaces 22, **22*a*, 22*b* and 22*c* in FIG. 1 of the drawings, it will be seen that the working surfaces are angularly disposed such that there is a component of force directed rearwardly, or to the right as viewed in FIG. 1**. This component of force provides the propelling force for the water wheel of the present invention.

Though the water wheel is illustrated as being formed of many separate parts, this is for clarity of illustration and discussion, and it should be understood that the device may be made as an integral piece. Even though the device may have to be cast or otherwise formed as separate pieces, it is contemplated that the pieces will be welded or otherwise joined together into a solid unit.

For small, individual vehicles, water wheels made in accordance with the present invention may be made of plastic or the like which may be glued or sonically welded. For larger vessel, the water wheels may be made of metals having the desired strength.

It will of course be understood by those skilled in the art that the device here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A water wheel, including a plurality of paddle members rotatable about an axis for providing flotation and propulsion forces, characterized by a disc perpendicular to said axis and extending along the center-line of said plurality of paddle members, said plurality of paddle members being fixed to said disc and extending from each side thereof, each paddle member having a leading edge inward of said disc and on a radius of said disc with the midsection of an adjacent paddle member, a working surface facing the circumference of said disc, and an outer end adjacent to said circumference, said disc comprising a pair of side walls defining a cavity therebetween, said side walls being joined at said circumference of said disc, a first fillet on one side of said disc fixed to said disc and to said paddle member, and a second fillet on the other side of said disc fixed to said disc and to said paddle member, both said first fillet and said second fillet being on the inward side of said paddle member, opposite said working surface, both said first fillet and said second fillet increasing in size from said leading edge to said outer end.

2. A water wheel as claimed in claim 1, and further including a plurality of bridge members extending across said cavity, said bridge members being located in transverse alignment with said paddle members.

3. A water wheel as claimed in claim 2, and including an axle disposed along said axis and fixed to a said disc for imparting rotation to said disc.

* * * * *